US006588352B2

(12) United States Patent
Kay

(10) Patent No.: US 6,588,352 B2
(45) **Date of Patent: *Jul. 8, 2003**

(54) WAY AS ACRONYM FOR WAVE AVOIDANCE YACHT

(76) Inventor: John Kay, Greenland House, 34 Victoria Road, Douglas Isle of Man IM2 4HE (GB)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 10/122,816

(22) Filed: Apr. 15, 2002

(65) Prior Publication Data

US 2002/0152941 A1 Oct. 24, 2002

Related U.S. Application Data

(63) Continuation-in-part of application No. PCT/US00/41479, filed on Oct. 24, 2000.
(60) Provisional application No. 60/161,313, filed on Oct. 25, 1999.

(51) Int. Cl.[7] ..... B63B 1/00
(52) U.S. Cl. ..... 114/61.12; 114/61.15
(58) Field of Search ..... 114/61.1, 61.12, 114/61.13, 61.14, 61.15, 61.16, 61.17, 61.18, 61.19, 121, 122, 124, 126

(56) References Cited

U.S. PATENT DOCUMENTS

| | | | | | |
|---|---|---|---|---|---|
| ,803,174 | A | | 10/1905 | Lake | |
| 1,757,174 | A | * | 5/1930 | Douglas | 114/61.13 |
| 3,830,178 | A | | 8/1974 | Lang | |
| 3,897,744 | A | | 8/1975 | Lang | |
| 3,903,827 | A | | 9/1975 | Marcil | |
| 4,335,987 | A | | 6/1982 | Laxo | |
| 4,494,472 | A | * | 1/1985 | Rougerie | 114/66 |
| 4,552,083 | A | | 11/1985 | Schmidt | |
| 4,669,683 | A | | 6/1987 | Guillory | |
| 4,763,596 | A | | 8/1988 | Yoshida | |
| 5,544,610 | A | | 8/1996 | Harding | |
| 6,439,148 | B1 | * | 8/2002 | Lang | 114/278 |

* cited by examiner

*Primary Examiner*—S. Joseph Morano
*Assistant Examiner*—Andrew Wright

(57) ABSTRACT

In operation for wave avoidance the WAY presents only a small profile and a small part of its total structure to the most dynamically active part of all ocean waves, their surface and crests. This includes all storm and rogue waves. In this mode the bulk of the vessel is distributed through lower more quiescent water and spans differentiated deep wave effect. In this mode the WAY has low above surface reserve buoyancy-able-to-induce unwanted motion. In wave avoidance mode when not underway, the WAY is stabilized by low reserve buoyancy of its wave piercing causeways (12). Underway the WAY behaves as a small wing effect hydrodynamic flying body and does not rely upon wings or hydrofoils which receive undesirable acceleration forces and motion from deep wave effect. Flight path is controlled by orientation which is controlled by a large separation between center of buoyancy and a purposefully moveable center of mass. A default trajectory is enabled where a small hydrodynamic lift is countered by small unbuoyed mass. A WAY has a surface or shallow water mode of operation. The word yacht in the title is to suggest a preferred embodiment of size lying between boat and ship; a size that in conventional vessels is subject to particularly nauseating sea motion. The WAY can be configured for passage making with internal motors and without sails.

10 Claims, 4 Drawing Sheets

17
17
14
14
22
24
27
13
24
22
25
25
12
12
W6
26
11
AL
AL
AL
18
18
16
16
19
19
21
34
15WF
15W
15V
15V
15V
15V
15V
15V
23

WAY AS ACRONYM FOR WAVE AVOIDANCE YACHT

CROSS-REFERENCE TO RELATED APPLICATIONS

This application is a Continuation-in-part of international application number PCT/US00/41479, filed Oct. 24, 2000 (pending) which was published under PCT Article 21(2) in English.

This application claims the benefit of United States Provisional Patent Application No. 60/161,313 Filing Date Oct. 25, 1999. The name of the invention has been changed with a less cumbersome acronym.

STATEMENT REGARDING FEDERALLY SPONSORED RESEARCH OR DEVELOPMENT

Not Applicable.

INCORPORATION-BY-REFERENCE OF MATERIAL SUBMITTED ON A COMPACT DISC

Not Applicable.

BACKGROUND OF THE INVENTION (1) Field of the Invention

This invention relates to marine vessels and yachts, specifically to vessels providing respite from wave induced accelerations.

(2) Description of Related Art Including Information Disclosed Under 37 CFR 1.97 and 1.98

Vessels, ships, boats and other water craft which float at the surface of the sea are effected by weather conditions in ways that are unwanted. Some vessels rely on wind for motive power and some even use waves for riding and entertainment, but in most instances waves and stormy weather result in unwanted motion or accelerations. Most floating water craft design is involved with ways to lessen the unwanted motion. The records of marine architecture are punctuated with methods to lessen undesirable motion for vessels both moored or navigating. Stabilizing fins and keels have a long history. Actively controlled stabilizing wings came, especially for large passenger ships though not without an economic cost and/or a power consumption penalty. More recently vessels described by the acronym SWATH for 'small-water-plane twin hull' and HYSWAS for 'hydrofoil-small-water-plane ship' have exploited using the relatively-calmer water lying below the surface in which to place some of the buoyancy volume and hydrodynamic-wing surface of the vessel. Vessels described as hydrofoils can lessen wave effect by raising more traditionally shaped hulls so there is less impact with the wave. SWATH, HYSWAS and Hydrofoil designs show effective reduction in undesirable motions and accelerations up to certain sea states. For higher sea states, in most designs and with a relationship to the size of the vessel, the vessels cease to be fully operable. For seas with waves larger than a given sea state their wave-avoidance effectiveness ends when waves impact their superstructure or main accommodation volume. SWATH, HYSWAS and Hydrofoil designs also rely on underwater horizontal wings to control their hydrodynamic flight at a particular depth. Unfortunately ocean-surface-wave effect can extend down to several times the surface wave height and perturb the flight of wings. Without optimally presenting themselves to every eddy of water motion, these wings can induce turbulence, thence drag and vibration to the vessel.

By way of examples, consider 1/ winged passenger airline flight in atmospheric thermal or turbulent conditions 2/ that wingless flying bodies are used in aeronautics.

Large size in a vessel can increase its parameters of operation to larger sea states but largeness of vessel is definitely not a universally suitable prerogative. Also some large cargo ships are regularly subject to being broken by the stresses set up by rogue waves, and ocean swells and associated troughs.

However to partly exemplify what is missing from marine vessel architecture and design is to look for the descriptive phrase 'Wave Avoidance', or perhaps more precisely 'wave effect avoidance'. This engineer has not been able to find the phrase 'Wave Avoidance' or 'wave effect avoidance' in the prior art. For vessels which in essence have a small water-plane area, all references would appear to refer to a plane of water. As seas get larger most prior art such as SWATH and HYSWAS can have operation limited by impact with waves, and especially as high speed vessels. Hydrofoil vessels can potentially jump from wave to wave with accompanying accelerations. All have to change operations for certain rogue waves. It is as if all have chosen to take on the wrong side of the ocean atmosphere interface in a challenge to deal with large waves while maintaining a smooth trajectory. HSWAS and other hydrofoils require a power input to achieve their lessening of wave effect.

The examples of prior art listed below are limited as none fully compares to the scope of this patent application.

Harding in U.S. Pat. No. 5,544,610 (1996) shows a cargo submarine. As its title implies it is operated as a submarine and requires stabilizers and active rudders for depth control. Its hull is shown as oval and flattened in cross section in the horizontal plane and described as 'horizontally hydrofoil shaped'. This geometry together with horizontal stabilizers make it especially susceptibly to surface wave effect and accelerations when operating with a submerged depth of less than approximately three times the surface wave height. It shows no means of default or self stabilization without power except to float at the surface.

Yoshida in U.S. Pat. No. 4,763,596 (1988) describes a type of SWATH vessel with twin submerged hulls and water planes which again require active wing control for their flight in water. These waterplanes are susceptible to perturbation by wave motion. Its large above surface accommodation make it susceptible to accelerations from collision with large or rogue waves.

Similarly Lake in U.S. Pat. No. 803,174, Lang in U.S. Pat. Nos. 3,830,178 and 3,897,744, Schmidt in U.S. Pat. No. 4,552,083 show the requirement for active wing control.

BRIEF SUMMARY OF THE INVENTION

In accordance with the present invention a passage making surface vessel can maintain a relatively smooth trajectory with relatively small changes in attitude or orientation with respect to the horizontal plane. The amount of vessel exposed to the maximum dynamic effect of any size wave is minimized in keeping with a useful access to the atmosphere. Upper surface structure of vessel is minimized in profile and area for interaction with surface wave effect. Lower surface structure of vessel is contoured for least interaction with all components of deeper wave effect and the unnecessary use of wing appendages is avoided. Surface contours of structure tend to favor no water flow direction save parallel to long axis of vessel. Favored-water flow guides vessel on a flight path determined by vessel attitude. Attitude of vessel is controlled by wide separation of center of buoyancy from a purposefully adjusted center of gravity. The underwater surfaces exposed to the lesser wave active water, create viscous dampening of vertical motion. The resulting dynamics on the vessel are to the greater degree controlled by the interaction with that less dynamic non surface water.

OBJECTS AND ADVANTAGES

It is therefore an object of the present invention to provide a new level of freedom from undesirable motion for all naturally occurring sea states in a floating vessel [of a given size]. This vessel provides accommodation, or accommodation and travel, near the ocean atmosphere interface.

Induced accelerations from surface waves of all sizes including storm waves and rogue waves, are more effectively avoided than in previous art floating vessels of comparable size. This wave effect avoidance is provided whether making passage, drifting or moored. This wave effect avoidance can be provided by default, that is, without using a power source or power input. It is also an object that this floating vessel can change its mode of operation to wet or dry dock and operate in shallow water.

All surface vessels can be moved by the buoyancy in a wave or swell, of their above waterline structure. Breaking waves and crests can impact the vessel and especially structure above the mean waterline. This motion can be amplified into an inefficient and uncomfortable oscillation by further waves. In the WAY the extra buoyancy and profile of above surface structure is small by comparison, and can not provide enough impetus to cause a motion on the scale felt by other surface vessels. As such the WAY can be described as a low reserve buoyancy vessel.

The large and separated into different water depth strata underwater surface area of the WAY restricts any short term fast oscillations that are out of synchronization with the average motion of the whole body of water that the WAY occupies. Horizontal wings (so called stabilizers on many vessels featuring underwater control) that can receive 1/ complex interference and a destabilizing influence from the vertical-component-of-deep-wave motion 2/ vessel-longitudinal drag, are not required. The WAY is a wingless-flying body when making passage in wave-avoidance mode. The structural exterior surfaces normally lying below the mean ocean surface and elongated parallel to the direction of passage, are mostly rounded on a 90 degree cross section. This is to ensure that water passage over these surfaces has generally no favored direction except parallel to the long axis of the WAY.

For motive-power efficiency the WAY contends with a greater wetted surface area than comparable-conventional-surface vessels. However this is offset by the advantages of lower surface-wave-producing resistance.

For embodiments with sailing rigs, 'knockdown' as experienced by more conventional yachts does not have the same implications, as the righting moment for the WAY is exceptionally high when in wave-avoidance mode. Similarly the possibility of capsize as for conventional vessels, is virtually non existent unless the whole body depth of water which the WAY occupies can roll fast enough to overcome this exceptionally large righting moment. The WAY is also engineered as a watertight entity able to suffer water over the deck.

Further objects and advantages will become apparent from a consideration of the ensuing description and accompanying drawings.

REFERENCE NUMERALS AND LETTERS IN DRAWINGS

| | | | |
|---|---|---|---|
| 11 | main hull. | 12 | causeway. |
| 13 | deck. | 14 | deck house. |
| 15 | ballast pod. | 15A | ballast pod in floating mode. |
| 15V | tank volumes. | | |
| 15W | ballast pod mostly flooded with water. | | |
| 15WF | ballast pod 15W moved Fore [as opposed to Aft]. | | |
| 15WM | ballast pod 15W canted to side [laterally] and opposing moment of force M. | | |
| 16 | keel spar. | 17 | mast. |
| 18 | two axes [at 90 degrees] rotation bearing joint, power-articulated. | | |
| 19 | single-axis rotation bearing joint. | | |
| 21 | propeller or thrust producer, engine-driven unit. | | |
| 22 | safety net at deck 13 perimeters . | 23 | solid ballast. |
| 24 | door to deck [facing aft/to stern]. | | |
| 25 | hatch-door separating causeway 12 from deckhouse 14. | | |
| 26 | hatch with waterproof seal. | 27 | removable section of deck 13. |
| 28 | tether and control wires to a traction kite. | | |
| 29 | means of ascension from a cabin floor to deckhouse 14. | | |
| 31 | single-axis rotation bearing joint with or without linear axis track bearing [alternative to 18]. | | |

-continued

| | | | |
|---|---|---|---|
| 32 | linear track bearing joint, non-rotational, power-articulated. | | |
| 33 | rigid joint. | 34 | steering control for the horizontal plane. |
| AL | axis longitudinal for bearings in 18 or 31. | | |
| B | beach [solid ground] surface or draught level. | | |
| M | resultant force on above water surface structure from wind and wind driven water. | | |
| W | Water surface or Water line. | | |
| W6 | six foot [~2 meter] Wave surface in approximate scale with the size of a WAY as illustrated. | | |
| WH | Water line High, example. | WL | Water line Low, example. |
| CBH | Center of Buoyancy of WAY at water line High example WH. | | |
| CBL | Center of Buoyancy of WAY at water line Low example WL. | | |
| CGA | Center of Gravity of WAY with ballast pod(s) Aft[ward]. | | |
| CGF | Center of Gravity of WAY with ballast pod(s) Fore[ward]. | | |

DETAILED DESCRIPTION OF THE INVENTION

Preferred Embodiment

Figure 1:
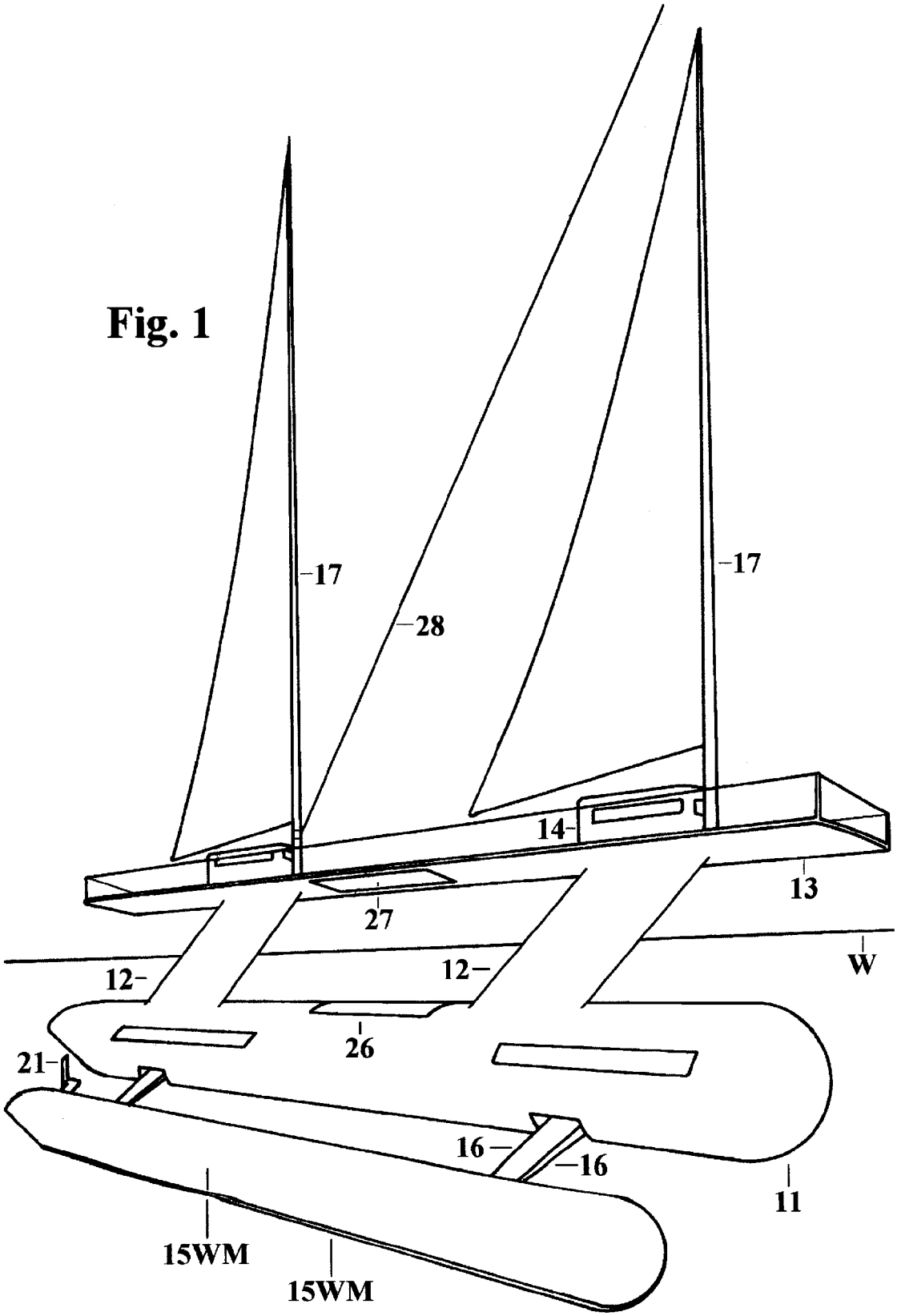
FIG. 1 shows a low detail perspective of a WAY with starboard side passing observer who is situated at water surface.

FIG. 1 shows a simplified perspective for an observer at sea surface level, of the starboard side of the WAY making passage in wave-avoidance mode under sail power. Ballast pods 15WM are swung to the starboard side to counter forces on the sails and above surface structure from a wind approaching the WAY from the observer's side. Tether and control wires 28 lead to a traction kite not shown.

Figure 4:
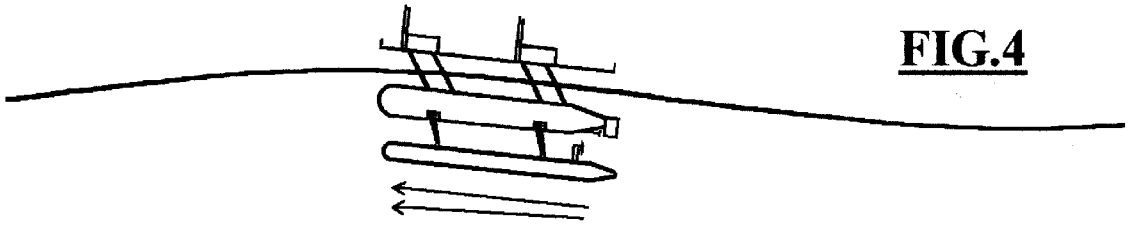
FIG. 4 shows a WAY in a bow up attitude and changing altitude in a long period smooth swell wave. The upper arrow represents the direction of the long axis of the WAY. The lower arrow represents the direction of travel through water. The change of altitude could be positive or negative dependant on the direction of movement of the swell and the speed of passage of the WAY.

FIG. 4 shows a view from the port side of a longitudinal-middle-section representation of a WAY in wave-avoidance mode. A main hull 11 with accommodation for personnel and cargo lies subsurface beneath the most dynamic part of the water, its surface waveform W6. A minimal-vertical-profile-grid deck 13 is held above the mean water surface. Deck 13 is carried by two rugged wave-piercing structurally-enclosed causeways 12 of minimal cross section in keeping with a useful causeway for passage of personnel and light cargo between atmospheric access on deck and the main hull. Causeways 12 are forwardly/bowwardly inclined such that their increased submersion WL to WH, effectively moves the center of buoyancy of the vessel towards the fore/bow, CBL to CBH, and vice versa. Causeways 12 are topped by deck houses 14 which are small relative to overall size of the WAY. Deck houses 14 carry observation windows, some of the WAY's navigation equipment and controls, and doors 24 facing towards the stern for access to the deck. Water tight secondary hatch-doors 25 separate causeway 12 passages from deck houses 14. It would be useful to have further water tight hatch-doors and bulk heads within the WAY. A mast 17 rises from each deck house 14. In keeping with a design premise of the WAY for minimal above-water-surface profile, masts 17 are free standing and engineered using carbon-fiber-composite technology for strength with flexibility. Masts 17 can carry sail and also act as hollow conduits for the transfer of air between the interior of the WAY and an elevated position in the atmosphere with a reduced presence of sea spray and water. Since sails are not the subject of this patent they are only represented in the perspective drawing FIG. 1. One of two water flooded ballast pods 15W is shown suspended parallel to and below main hull 11 by keel spars 16. There are two keel spars 16 per ballast pod 15. Each ballast pod 15 contains solid ballast 23 and has multiple tanks or volumes 15V which are separated by bulkheads. Ballast pod[s] 15 are selectively moved and positioned in three dimensions relative to the main hull by alternative engineering solutions. The movement and position reached is controlled by gears and or hydraulics. One solution is a/: Keel spars 16 connect to ballast pods 15 with single-axis bearings 19 at right angles to the long dimensions of hull 11 and ballast pods 15. Keel spars 16 connect to main hull 11 in rotation-bearing joint 18 with three axes. One axis AL runs through both rotation-bearing joints 18 parallel to the length of hull 11 and allow ballast pods 15 to be moved transversely to port or starboard in an arc. An axis in each rotation-bearing joint 18 at right angles to the length of main hull 11 and parallel to axis bearings 19 allows ballast pods 15 to be moved fore or aft in an arc. A second solution is b/: Keel spars 16 connect to hull 11 in single-axis-rotation-bearing joints 31 [FIG. 10] bearing on an axis AL parallel to the length of hull 11 which allow ballast pods 15 to be moved traversly to port or starboard in an arc. Longitudinal positioning of the ballast pods 15 relative to the main hull 11 is controlled through linear travel along axis AL of the two joints 31. Keel spars 16 can then be attached into ballast pods 15 with rigid joint 33. Alternatively or for additional travel, relative longitudinal positioning can be provided by two linear track bearings 32 [FIG. 11] per ballast pod 15. Traverse motion in an arc for each ballast pod 15 can be independent, up to a limit imposed by the position of the other pod 15. Both ballast pods 15 can lie together and move as one effective and more hydrodynamically smooth pod. Independent longitudinal motion of each ballast pod 15 is also provided for example by, linear track bearings 32. There are other solutions to moving ballast pods 15 in three dimensions relative to main hull 11.

Figure 5:
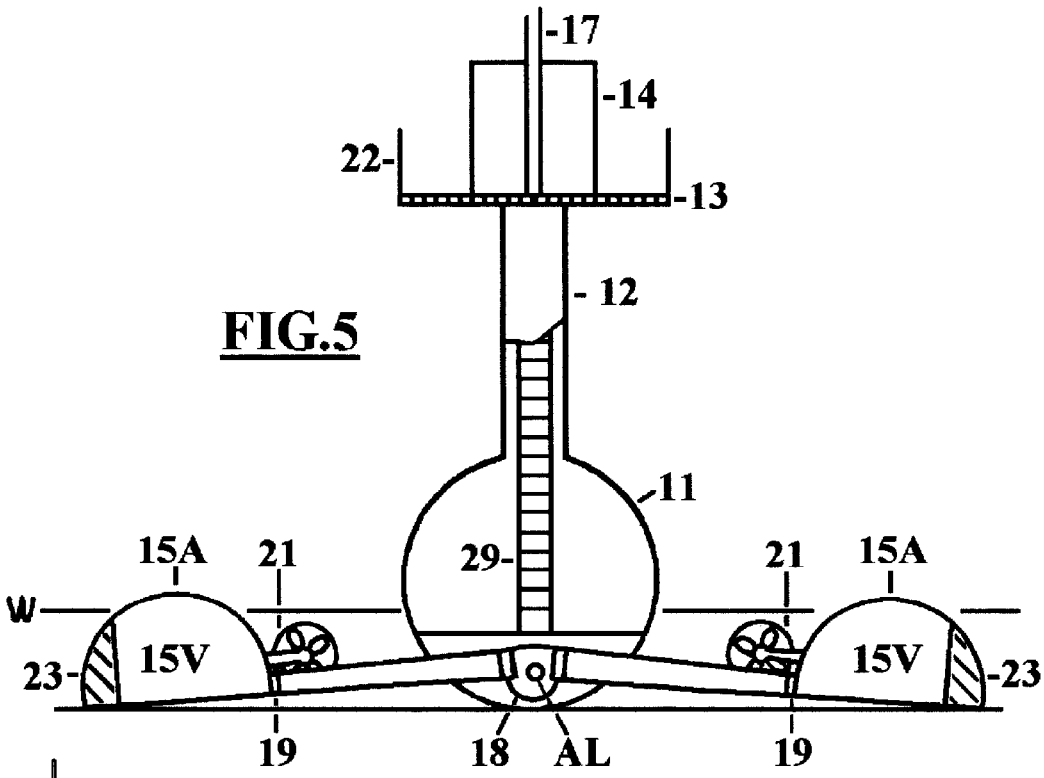
FIG. 5 shows a transversally sectioned view of a WAY in minimum-draught mode.

FIG. 5 shows a traverse section [through a causeway 12 and power-articulated two-axes [at 90 degrees] rotation-bearing joint 18] view of WAY in minimum draught mode with tank volumes 15V empty of water. Protected position and wide separation of propeller-engine-driven units 21 is shown. The word propeller is used in the context of any thrust producing device.

Figure 6:
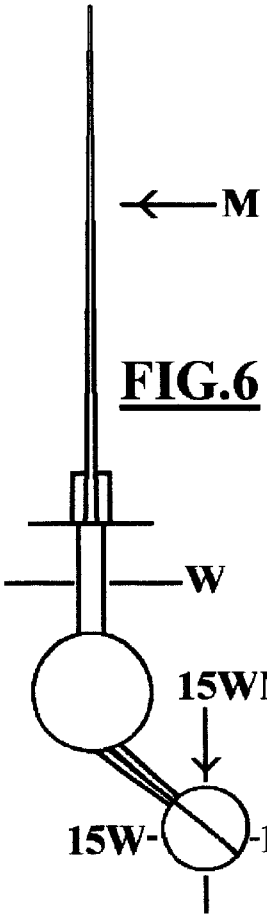
FIG. 6 shows a simplified end view of a WAY with hull and deck horizontal where ballast pods 15W are canted to one side to counter forces acting on the above-water-surface structure.

FIG. 6 shows a simplified end view of WAY in wave-avoidance mode. Ballast pods 15W are positioned to one side to prevent list of WAV from moment of force of wind effect M on above surface structure.

Figure 7:
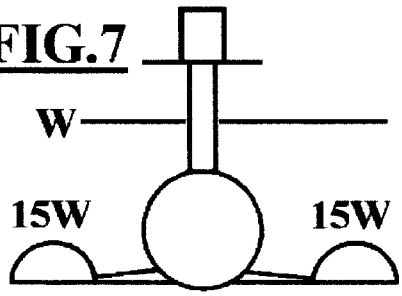
FIG. 7 shows a simplified end view of a WAY at its wave avoidance waterline with minimum draught.

FIG. 7 shows a simplified end view of a WAY with a minimum draught while in wave-avoidance mode.

Figure 8:
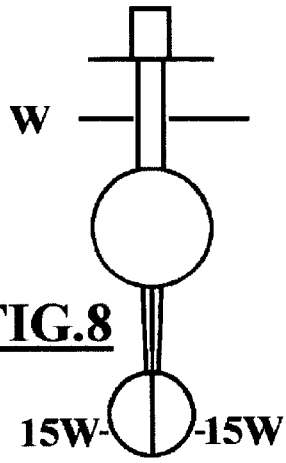
FIG. 8 shows a simplified end view of a WAY at its wave-avoidance waterline with maximum draught.

FIG. 8 shows a simplified end view of a WAY with a maximum draught while in wave-avoidance mode.

Figure 9:
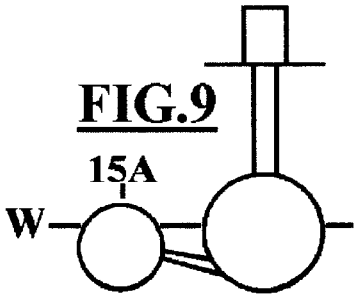
FIG. 9 shows a simplified end view of a WAY with a single ballast pod 15A in minimum-draught mode.

FIG. 9 shows a simplified end view of an alternative embodiment of WAY in minimum-draught or surface mode. This embodiment features a single ballast pod 15A.

Figure 2:
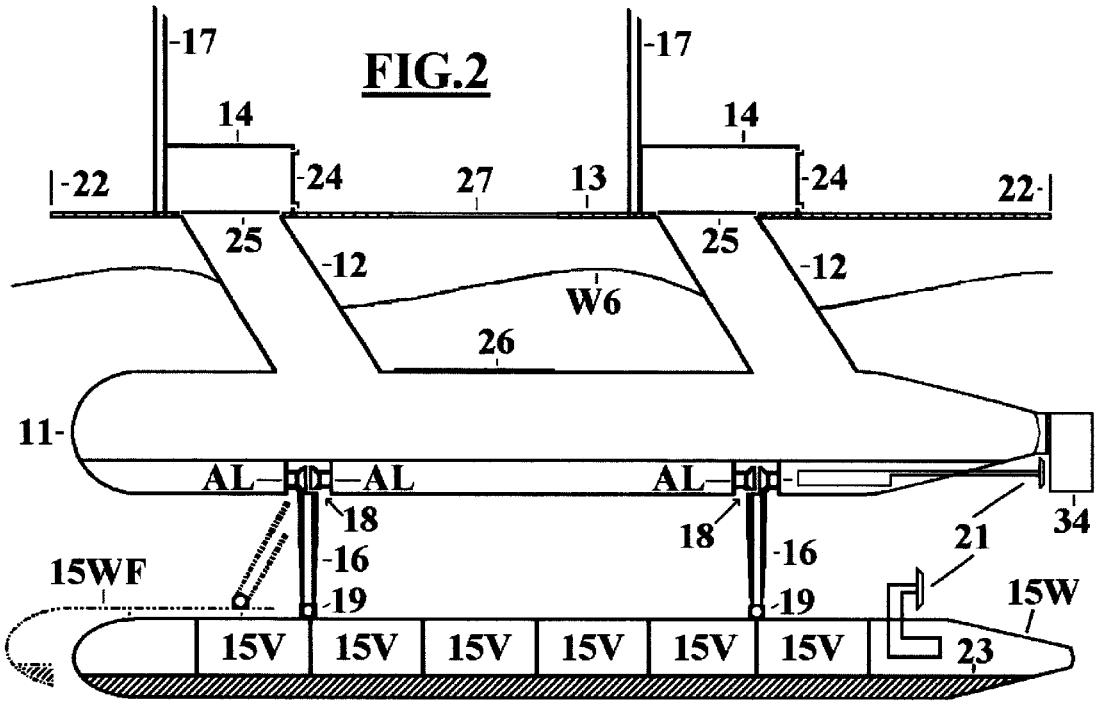
FIG. 2 is an overall view from the port side of a WAY sectioned open longitudinally and with parts identification. This embodiment of the WAY has forwardly inclined causeways 12.
Figure 10:
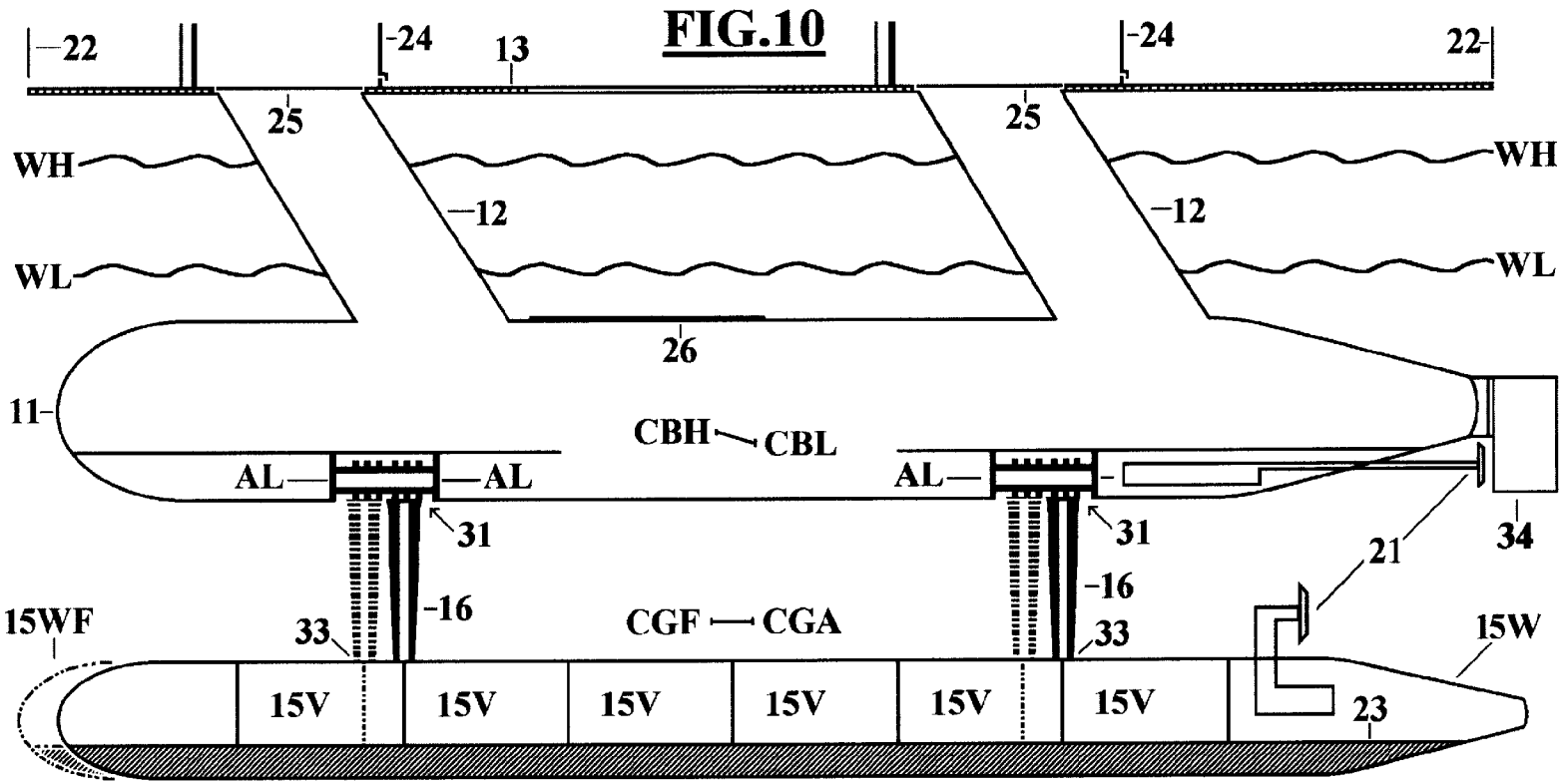
FIG. 10 shows part of the view as in FIG. 2 but featuring an alternative means for controlled longitudinal positioning of the ballast pod[s] 15 relative to the rest of the WAY.

FIG. 10 shows part of a similarly sectioned representation as in FIG. 2. Shown is the change of center of buoyancy of WAY, CBH to CBL for submergence of the causeways 12 to different waterlines WH and WL respectively. Also shown is an alternate [to FIG. 2] arrangement for longitudinal motion of ballast pods 15 relative to main hull 11.

Figure 11:
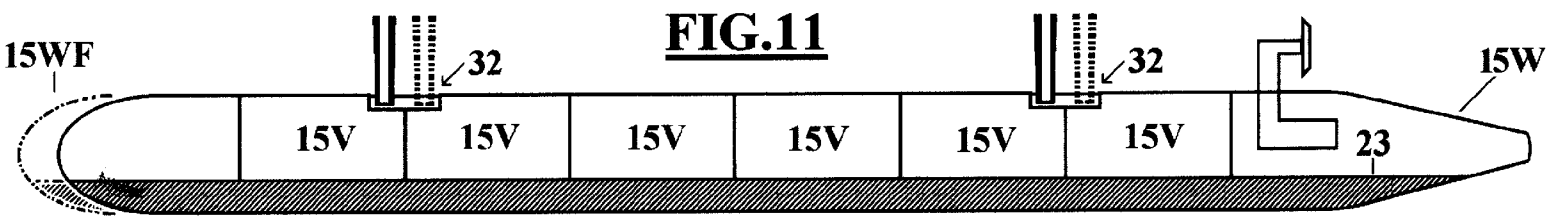
FIG. 11 shows an alternative or supplementary means to the longitudinal positioning shown by FIG. 10.

FIG. 11 shows another alternate [to FIG. 2 and FIG. 10] arrangement for longitudinal motion of ballast pods 15 relative to main hull 11.

Preferred Embodiment—Operation

When in wave-avoidance mode the WAY avoids being accelerated by waves 1/ by having low reserve buoyancy and presenting a small profile to water in the most dynamic part of the wave, its surface and 2/ by presenting the larger part of its surface areas in more quiescent water, well below surface and in several strata. The lower the strata the more quiescent the water is likely to be. When the WAY is not making passage through the water, the causeways 12 positioned towards the fore and aft of the WAY provide the reserve buoyancy which tend to stabilize the WAY in its wave avoidance mode by default.

The WAY can purposefully vary its draught and reserve buoyancy and as such it has different modes of operation. A minimum draught with maximum-reserve buoyancy or surface mode is shown in FIG. 5 where tank volumes 15V are filled only with air and keel spars 16 are locked in position. Ballast pods 15A have reserve buoyancy when they contain no water and this provides for a stable WAY with very strong self righting capabilities up to a limit of 90 degrees from the horizontal. These very strong self righting capabilities result from the difficulty of raising the extreme mass of each pod 15A out of the water, given the large buoyancy of main hull 11. The buoyancy of main hull 11 is approximately double the mass of a single pod 15A with tanks 15V filled with air. In minimum draught mode FIG. 5, the WAY can be motored, sailed, moored or beached. Minimum draught mode allows the WAY to navigate waters too shallow for wave avoidance mode. The efficiency of transit through the water is lower than in wave avoidance mode because of the wave making effects of main hull 11 and ballast pods 15A at the surface. However the increased height above water surface for deck 13 and deck houses 14 provides for excellent visibility for navigating inshore and in harbour environments. Minimum-draught mode still provides for wave induced accelerations far below those experienced by conventional vessels, and similar to those experienced by surfaced submarines and for the same reasons. Those reasons are; rounded-above-surface structure tending to deflect or avoid waves coming from any direction, combined with large submerged surface and mass.

When in wave-avoidance mode there is also a minimum-draught position for ballast pods 15W as shown in FIG. 7 where the tanks 15V contain water. Position FIG. 7 can be used when there is insufficient depth of water for lower placement of ballast pods 15. The strongest correction for a lateral moment of force such as a strong cross wind on sails, is not available. Position FIG. 7 thus has a limited utility but may be used for wave avoidance in shallow water while drifting or using engine power, or when moored. In position FIG. 7 a lateral list can be corrected by exchanging on the appropriate side, some water for air in tanks 15V. In position FIG. 7 ballast pods 15W can be moved fore or aft independently for longitudinal attitude of WAY and hydrodynamic flight control. With the WAY moored or anchored in a current and in wave avoidance mode, the ballast pods 15W might be incrementally moved sternwise to counter the downward tug of an anchor line on the bow. This might also involve expelling some ballast water from tanks 15V if reserve buoyancy left in causeways 12 becomes too small because of downward pull of anchor line.

As described there is a range of operation for the WAY between minimum and maximum draught with no restrictions for an intermediate draught other than a possible lesser or different performance. For instance, there is the occasion where the crew want to lessen the chance of water breaking on deck 13 at the expense of less wave avoidance or smoothness of ride. In this circumstance they may opt to have the WAY ride higher in the water body.

Each ballast pod 15 can be moved or swung independent of the other up to a lateral position imposed by the position of the other. For most general cruising in deep water in wave-avoidance mode, ballast pods 15W lie nested or adjacent to each other and are swung or moved in concert. Together as a unit, ballast pods 15 are hydrodynamically more efficient, and drag for longitudinal passage is reduced.

Each tank 15V is individually controlled for the proportion of air and water it contains. As such there is some duplicity of effect between the moveability of ballast pods 15 and the ballast effect of individual tanks volumes 15V. The duplicity of effect is limited but can provide a margin of safety for a failure of a part of the system. For instance, changing the ballast effect of individual tank volumes 15V negatively or positively can compensate for an inoperable rotation-bearing joint 18. Moving ballast pods 15 relative to hull 11 can compensate for a failure in the pumping system for all or individual tank volumes 15V, by hydrodynamic flight when WAY is in motion.

When travelling longitudinally through the water body, the surfaces of the WAY can act hydrodynamically for lift or wing effect. Wing effect is stronger in wave avoidance mode when a normal maximum vessel surface interacts with water. Overall wing effect is small but sufficient for depth control. A large wing effect could cause perturbations from deep water wave motion. For other than slow speeds, making passage with wave avoidance can be optimized by control of attitude for maintaining mean waterline position. This is most conveniently left to an automated system which requires 1/ a sensor for overall orientation of WAY [i.e. deck 13 and hull 11] with respect to the horizontal plane 2/ sensors for depth of immersion of various parts of the WAY below the mean water surface. These sensors feed a computer. Dependant on the mode of operation of the WAY, the computer can control motors in joints 18 or 31 and 32 for moving the ballast pods 15, and pumps controlling ratio of water to air in tank volumes 15V. For instance, in wave-avoidance mode if sensors detect excessive average submersion for optimum wave-avoidance altitude as WAY makes forward passage, ballast pods 15W would be moved incrementally towards stern to tilt WAY bow upwards to gain hydrodynamic lift for WAY. If a crosswind on sails increased and sensor detected list, ballast pods 15W would be swung incrementally to counter list. Sophistication is important to the best performance and a programmable computer able to interpret a wide field of data aids in this performance.

For security in the face of a breakdown of computer control and/or power for keel spar 16 movement, two basic modes of the WAY should be available as defaults. They are 1/ maximum buoyancy FIG. 5 with the ballast pods 15A purged of ballast water and floating alongside hull 11 and 2/ wave avoidance position FIG. 2 with ballast pods 15W directly below hull 11. With a breakdown as suggested, these two modes can provide: passage with sail and or motor at a reduced speed, riding out storm conditions in relative comfort, entry to shallow water. Manual cranking of hydraulic pumps and keel spars 16, stockpiled compressed air in cylinders for rapid purging of water from tank volumes 15V and a mechanism for rapidly releasing solid ballast 23 are examples of security features incorporated in the preferred embodiment of the WAY. Purging of water from ballast pods 15W one at a time while keeping the other pod locked in position, can float ballast pods to position 15A FIG. 5 while still maintaining a strong righting moment for the WAY. Similarly it is possible to park both pods 15A together on one side of hull 11 for economy of space at a berth. This position would appear similar to the representation of FIG. 9.

Figure 3:
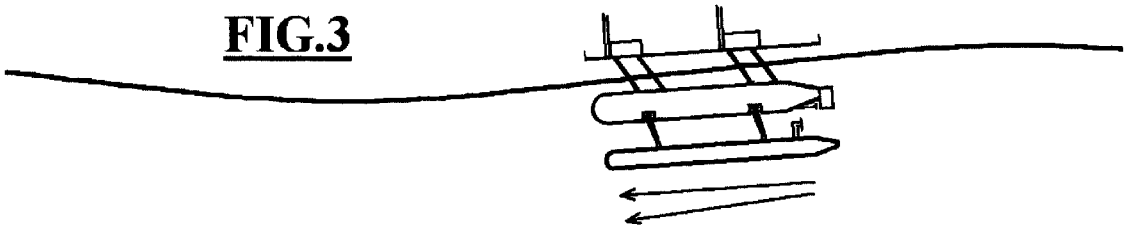
FIG. 3 shows a WAY in a bow up attitude with respect to the local mean water surface and changing altitude in a long period ocean swell. The upper and lower arrows represent respectively; the direction of the long axis of symmetry of the WAY, the direction of travel of the WAY through water.

For situations requiring more of a default operation of the WAY when under way, ballast pods 15W can be parked in the vertical center longitudinal plane as shown in FIG. 8 and with the ballast pods set slightly aft as shown in FIG. 3 and FIG. 4, so as tilt the long axes of hull 11 and pods 15W slightly up towards the surface at the bow, thereby creating a small lift. This lift can compensate for any squat of the vessel, or the tendency of a wave effect or wind change to rotate the vessel into a dive attitude. Further lift beyond any compensation for squat, will result in an equilibrium being reached when some buoyancy provided by the causeways 12 is lost. This simplified mode of operation may provide a convenience or fall back mode for certain weather states or travel speeds, where stricter maintenance of attitude and altitude is not called for, or not possible. This mode of operation causes the WAY to follow by default a trajectory governed by the altitude of the ocean surface. That trajectory will not significantly change for individual short period waves. In other words the trajectory of the WAY can be considered smooth. For long period waves or swells with a height greater than the height of the causeways 12, and wavelength that is long in comparison to the length of the WAY as in FIGS. 3 and 4, the WAY can avoid submersion of its deck 13. Note that; wave height is defined as the vertical distance between trough and crest.

The position of the center of buoyancy is dependent on the depth of immersion of the WAY. With the causeways 12 inclined towards the bow, greater depth of immersion of the causeways 12 will cause the center of buoyancy to move slightly forward and higher. Lessening immersion will move the center of buoyancy slightly aft towards the stern, and lower. FIG. 10 shows an example of two depths of immersion at Waterlines WH and WL. The line CBH-CBL is an example of the possible track of movement for the center of buoyancy. For wave avoidance mode, the WAY's water ballast load in volumes 15V is generally adjusted to statically float the WAY at an intermediary vertical height of the causeways 12 as in FIGS. 1, 2, 6, 7 and 8. When underway, the change in position of the center of buoyancy can cause the vessel to self correct for its depth of immersion. The wide separation between the centers of gravity and buoyancy, favors that the former will almost always be lower in elevation than the latter, and this suggests high stability.

Because bad weather experiences at sea have been the catalyst for developing the WAY, it also brings attention to the issue of safety. Because the WAY adopts this rather steady position in water that may be raging all around, particular attention has to be paid to what happens on deck. Obviously there is usually a slow transition from good weather to storm conditions where a crew can make preparations and then retreat to the safety of interior quarters. However there is also a problem of rogue waves which can even appear on a more or less calm sea. Such a rogue wave can be a problem for any vessel where the crew may have become complacent with the fair weather. Such a wave can break over a deck and sweep off what is not tethered. Most reserve buoyancy vessels will at least rise on meeting such a wave and may lessen the amount of water breaking over. Of course this sudden lurch of a vessel may be a danger in of itself. However in the case of the WAY and especially when in wave-avoidance mode, the WAY is not necessarily going to rise in synchronization with a large rogue wave. To address these issues the following features are or can be incorporated. Doors 24 between deck houses 14 and deck 13 face to the stern away from the most likely high water approach. An interlock mechanism ensures that either door 24 or hatch-door 25 is closed and watertight before the other door can be opened. A RADAR or optical detection system is operating to warn of approaching high waves. Deck 13 is surrounded by a safety net 22 of large lattice for low interaction with wind, spray and bulk water. Deck 13 is constructed as a metal grid and carries slats on its underside. These slats are pushed to block the grid by and to rising water but freely allow water to drop through the grid under gravity.

Because of the possibility of very large or rogue waves passing over deck 13 the rigging for sail on the WAY is specialized. The masts 17 are free standing and likely engineered with carbon fiber composite for flexibility and strength. This results in mast tapering in section from base to top. The lower hollow portion of masts 17 serve to duct ventilation air between WAY interior and clear atmosphere. Mechanized self furling sails are carried comparatively high above the ocean surface because the WAY can produce comparatively very high righting moments with deck 13 remaining horizontal. These comparisons refer to most sailing yachts. Sails can be controlled by shrouds which release tension should the event of a water-load occur. The development of reliable efficient kite sails may allow for a WAY yacht of small size which could suffer complete envelopment of its deck area in a large wave while maintaining sail power.

Making passage under engine power involves considerations of noise and maneuverability. Placement of motors and propellers 21 in and outboard respectively of ballast pods 15 provides for both sound insulation from hull 11 and turning moment in navigating the WAY. In inshore maneuvering minimum draught mode FIG. 5 provides a wide separation of propeller thrust.

In the list of Reference-Numerals-and-Letters, propeller 21 is also described as thrust producer. This is to indicate that propulsion could come from a means that has less of an appendage for interaction with wave motion. Steering control for the horizontal plane 34 could be a conventional rudder or alternatively an athwart thruster.

Loading and unloading of items too large or heavy for taking through causeways can be accomplished in minimum-draught mode FIG. 5. Hatch 26 is opened. Section of deck 27 can also be swung open or removed, for transfers using a crane or using a hoist from masts 17.

Other Embodiments

WAY with Single Ballast Pod.—Description

FIG. 9 shows a simplistic end view of a WAY with a single ballast pod in minimum-draught mode. Having a single ballast pod can simplify the construction and costs but sacrifices some of the versatility of a two pod WAY.

WAY with Single Ballast Pod.—Operation

Ballast pod 15A can be locked in position for stability of WAY. Pod 15 can be sunk by flooding of tank volumes 15V to draw the WAY down into wave-avoidance position. However careful control of coupling 18 is required to ensure hull 11 and deck 13 remain with suitable attitude. It is preferable if hull 11 and deck 13 have a self righting moment in of themselves. This is quite possible given the amount of machinery housed in the bilge of hull 11 and the use of light alloys for deck 13 and deckhouses 14. Maneuverability with engines is less than in the preferred embodiment.

Motor WAY.—Description

The WAY can be embodied without the use of specialized sails for making passage with on board motor power of various alternatives.

Diving WAY.—Description

The WAY in its preferred embodiment does not require many additional features to accomplish deeper submersion. The preferred embodiment features complete integrity against the ingress of water where air exchange is accomplished through mast ducts.

Diving WAY.—Operation

As described for the preferred embodiment, when making passage hull 11 and ballast pods 15 act hydrodynamically for lift. Using motor power and ballast shift the WAY can be directed into complete submersion with a default return to the surface if motive power is stopped. This application of a WAY could find use as an emergency maneuver for collision avoidance. This application of a WAY could find use for observation. Further ballasting could further submerge a WAY without making passage. This might find application for storm avoidance particularly for small versions of the WAY.

Habitat WAY.—Description

A simplified WAY without cruising sails or motors could find application as a habitat with security and freedom from uncomfortable motion in turbulent weather conditions.

Habitat WAY.—Operation

Such a habitat might be used for marine observation or as a staging base, and might be moored by drogue or anchor.

CONCLUSIONS, RAMIFICATIONS, AND SCOPE

The WAY provides a mobile accommodation environment on the ocean with higher intrinsic attitude stability and lower cyclic accelerations than other mobile surface vessels in its size class, and especially when weather and sea condition are anything other than calm. Where rough sea conditions pose something of a crisis or discomfort for personnel and equipment on a conventional vessel, the purpose is that these same conditions will appear to be, and effectively be, more benign.

The size of a WAY most suited to a preferred embodiment lies below that of large cargo ships and tankers, and passenger or cruise ships where most sea states are small compared with the size of the vessel.

Accordingly, it can be seen that it is appropriate to introduce the WAY to widen the art of marine vessel architecture and design, as an ocean-atmosphere interface vessel which presents itself largely below, as opposed to conventional vessels which present themselves largely above the interface. No literature other than that associated with this invention, has been found by this author which describes any floatable vessels with dry accommodation for personnel and cargo; which are configured to present the least amount of structure to the most dynamically active part of all potential waves, their surfaces, while providing for the least amount of active or passive interaction with shallow and deeper wave effect. Prior art semisubmersible vessels call for or use either foils, wings, canards, and in some cases ellipsoid cross sectional shapes. These appendages or shapes require control for angle of attack and can absorb substantial power. If not optimally controlled they can contribute to wave effect induced accelerations on the vessel. As such these vessels have little default wave effect avoidance. Summarize these differences with the ability of the WAY to carry a large area of sail high aloft and remain stable in attitude; and the WAY presents itself as unique Various other names have been coined to describe the WAY and its characteristics. Among them: STASS vessel [Smooth Trajectory All Sea State] or STASSY describing a Yacht: SPASS vessel [Steady Platform All Sea State] and WERV for Wave Effect Reduction Vessel Although the description above contains many specificity's, these should not be construed as limiting the scope of the invention but as merely providing illustrations of some of the presently preferred embodiments of this invention. Various other embodiments and ramifications are possible within it's scope. For example, the WAY can be embodied without any motive power means and be towed to location. It would be useful as a low motion accommodation, staging post or observatory. The WAY can be configured with a single causeway 12.

Thus the scope of the invention should be determined by the appended claims and their legal equivalents, rather than by the examples given.

SEQUENCE LISTING

Not Applicable.

What is claimed is:

1. For accommodation, a stabilized and smooth-trajectory at-the-ocean-atmosphere interface horizontal-passage-making-low-reserve-buoyancy-in-water vessel with steering control, comprising a. principal accommodation in the form of a buoyant main-hull hydrodynamically shaped for low-resistance-longitudinal submarine flight, said main-hull is held submarine;

b. an above-the-mean-water-surface deck for atmospheric access and operations;

c. at least one hydrodynamically-shaped causeway of minimal-cross-sectional area in keeping with a useful causeway connecting said main-hull and said deck, said at least one causeway provides the small buoyancy change which tends to stabilize said vessel at its mean ocean surface waterline when not underway;

d. at least one massive hydrodynamically-shaped ballast-pod held away from and generally parallel to said main-hull: the position of said at least one ballast-pod can apply a moment of force to orient said vessel for stability and hydrodynamic flight path, said at least one ballast-pod reaches water of a different wave dynamic to that effecting said main-hull;

e. at least one keel-spar ending in joints and connecting said at least one ballast-pod to said main-hull: said at least one keel-spar is articulated from said main-hull, said at least one ballast-pod or said main-hull and said at least one ballast-pod, to position said at least one ballast-pod in three dimensions relative to said main-hull.

2. For accommodation, a stabilized and smooth-trajectory at-the-ocean-atmosphere interface horizontal-passage-making-variable-buoyancy-in-water vessel with steering control, comprising a. principal accommodation in the form of a buoyant main-hull hydrodynamically shaped for low-resistance-longitudinal-submarine flight with an exterior surface rounded in planes 90 degrees perpendicular to the long axis and favoring longitudinal water flow, said main-hull is held submarine when in wave-avoidance mode;

b. an above-the-mean-water-surface deck for atmospheric access and operations with minimal vertical profile and minimal solid horizontal area, in keeping with sufficient strength and utility;

c. at least one hydrodynamically-shaped causeway of minimal-cross-sectional area in keeping with a useful causeway connecting said main-hull and said deck, said at least one causeway provides the small buoyancy change which tends to stabilize said vessel around its mean wave avoidance waterline when in wave-avoidance mode and not underway;

d. at least one massive hydrodynamically-shaped ballast-pod individually held away from and generally parallel to said main-hull, when two said at least one ballast-pod are incorporated they can be brought together to nest as one hydrodynamic shape for low-resistance-longitudinal-submarine flight with an exterior surface rounded in planes 90 degrees perpendicular to the long axis and favoring longitudinal water flow: the net buoyancy of said at least one ballast-pod is variable from strongly negative when in wave-avoidance mode to positive when said vessel is in minimum-draught mode: the position of said at least one ballast-pod can apply a moment of force to orient said vessel for stability and hydrodynamic flight path, said at least one ballast-pod reaches water of a different wave dynamic to that effecting said main-hull;

e. at least one keel-par ending in joints and connecting said at least one ballast-pod to said main-hull: said at least one keel-spar is articulated from said main-hull, said at least one ballast pod, or said main-hull and said at least one ballast-pod, to position said at least one ballast-pod in three dimensions relative to said main-hull.

3. The vessel according to claim 2 where said at least one causeway rises from said main-hull with an incline towards the bow such that the center of buoyancy of said vessel is moved longitudinally closer to the bow in relation to the depth of immersion of said at least one causeway in the water body.

4. The vessel according to claim 3 and further comprising a mechanism to rapidly release and separate solid ballast from said at least one ballast-pod where integrity of buoyancy of said vessel is compromised.

5. The vessel according to claim 4 wherein said deck incorporates a one way downwardly porous grid structure with the ability to rapidly and freely drain any water breaking over said deck.

6. The vessel according to claim 5 and further comprising;

a. at least one propeller and motor incorporated with said at least one ballast-pod and or said main-hull, b. a sailing rig on said deck, c. a safety net around said deck, d. a computer-control system for changing, maintaining and optimizing position and passage of said vessel in different operational modes: said computer-control system reads sensors for the orientation of said vessel with respect to the horizontal plane, mean waterline or the depth of immersion, the speed of passage through water and more parameters relative to safety and efficiency of operation: said computer-control system controls position of said at least one ballast-pod relative to said main-hull and the ratios of air to water ballast in different parts of said at least one ballast-pod.

7. The vessel according to claim 4 and further comprising at least one propeller and motor incorporated with said at least one ballast-pod and or said main-hull.

8. The vessel according to claim 4 and further comprising a sailing rig on said deck.

9. The vessel according to claim 4 and further comprising a safety net around said deck.

10. The vessel according to claim 4 and further incorporating a computer-control system for changing, maintaining and optimizing position and passage of said vessel in different operational modes: said computer-control system reads sensors for the orientation of said vessel with respect to the horizontal plane, mean waterline or the depth of immersion, the speed of passage through water and more parameters relative to safety and efficiency of operation: said computer-control system controls the position of said at least one ballast-pod relative to said main-hull and the ratios of air to water ballast in different parts of said at least one ballast-pod.

* * * * *